US006557381B1

(12) United States Patent
Reester

(10) Patent No.: US 6,557,381 B1
(45) Date of Patent: May 6, 2003

(54) HIGH CAPACITY WEB WINDING APPARATUS FOR USE IN CONJUNCTION WITH A ROTATING CIRCULAR KNITTING MACHINE

(75) Inventor: Karl Reester, North Syracuse, NY (US)

(73) Assignee: Tompkins Brothers Company, Inc., Syracuse, NY (US)

( * ) Notice: Subject to any disclaimer, the term of this patent is extended or adjusted under 35 U.S.C. 154(b) by 0 days.

(21) Appl. No.: 10/095,735

(22) Filed: Mar. 12, 2002

(51) Int. Cl.[7] ..... D04B 27/34
(52) U.S. Cl. ..... 66/153; 66/151
(58) Field of Search ..... 66/151, 152, 153, 66/149 R, 147; 242/548, 548.1, 157.1, 476.7, 476.9

(56) References Cited

U.S. PATENT DOCUMENTS 4,765,157 A * 8/1988 Okada ..... 66/151
4,879,886 A * 11/1989 Okada et al. ..... 66/151
4,888,963 A * 12/1989 Scherzinger et al. ..... 66/151
4,986,483 A * 1/1991 Ryu et al. ..... 242/159
5,457,967 A * 10/1995 Scherzinger ..... 66/151
5,575,162 A * 11/1996 Gray et al. ..... 66/149 R
6,023,949 A * 2/2000 Lonati et al. ..... 66/153
6,082,143 A * 7/2000 Noonkester et al. ..... 66/147
6,381,993 B1 * 5/2002 Daiber ..... 66/151

* cited by examiner

*Primary Examiner*—Danny Worrell
(74) *Attorney, Agent, or Firm*—Wall Marjama & Bilinski LLP

(57) ABSTRACT

An apparatus for receiving the web output of knitted material from a rotating circular knitting machine includes a web-retaining member which is supported for movement along a first axis that a perpendicular to a web transport path. The web is collected in a rolled form on a support using a drive mechanism which is synched to the rotation of the knitting machine. The web-retaining member is attached to a reciprocating traverse assembly which is driven by the synched drive mechanism, the traverse assembly permitting the web retaining member to move reciprocally in a linear path along the first axis, thereby permitting increased volume of web fabric to be wound onto the support.

11 Claims, 8 Drawing Sheets

120
114
210
180
176
210
198
190
206
160
117
196
202
152
150
153

HIGH CAPACITY WEB WINDING APPARATUS FOR USE IN CONJUNCTION WITH A ROTATING CIRCULAR KNITTING MACHINE

FIELD OF THE INVENTION

This invention relates to the field of knitting machines, and in particular to a winding apparatus used in conjunction with a rotating cylinder or other form of knitting machine which produces a rotating web output. The winding apparatus permits a significant increase in the volume of web output which can be collected in a rolled form.

BACKGROUND OF THE INVENTION

Typically the web output of a knitting machine, and more particularly that from a rotating cylinder circular knitting machine, as described in, for example, U.S. Pat. Nos. 4,765,157, 5,575,162, and 5,881,571, among others, is wound in relation to the machine into a roll for storage. In general, the web output is pulled from the knitting machine onto a winding assembly which takes up the output and forms a roll onto a tubular element or other support which winds the web thereupon. In the meantime, the winding apparatus must be coupled to rotate in synch about the axis of the rotating cylinder, since the web output is also rotating as it exits the knitting machine.

The overall size of a roll of web output that is created is encumbered, particularly for rotating circular knitting machines, in that the winding operation for these machines to date can only be performed in a single direction; that is, only along the direction of the web transport path. Therefore, and depending on the width of the web output, the rolls which are created by prior art winding apparatus are relatively narrow with a finite volume (e.g., length) of material. Therefore and in the course of a typical work shift, a number of completed winding operations (e.g., rolls of web fabric material) must be pulled from the machines requiring periodic supervision of each winding operation. The above creates inconvenience in order to shut the machine down, remove the as wound roll of web fabric material, and initiate the winding of a new roll several times in a typical work shift.

There is an overall need in the field to be able to increase the volume of web knit material which can be collected onto a roll without necessarily increasing the diameter of the roll.

SUMMARY OF THE INVENTION

It is a primary object of the present invention to overcome the above-noted deficiencies of the prior art.

It is another primary object of the present invention to devise a winding apparatus for a rotating circular knitting machine, such as, for example, a rotating circular cylinder knitting machine, which is capable of winding greater volumes of knitted fabric than previously known apparatus.

Therefore and according to a preferred aspect of the invention, there is disclosed a web winding apparatus for receiving the web output of knitted material from a rotating cylinder circular knitting machine, said web winding apparatus including a movable assembly which is supported for rotational movement along a first axis which is perpendicular to a web transport path;

collecting means for collecting said web output in a rolled form; and traverse means for permitting said movable assembly to move in a reciprocating fashion along a linear path extending along said first axis to permit additional widths of web output to be wound onto said collecting means.

The traverse means preferably includes a lead screw assembly having a movable portion which reciprocates in response to rotational movement of an axle retaining the web retaining member. The movable portion of the lead screw assembly is fixedly attached to a web retaining member, the web-retaining member and the movable portion each moving in a controlled reciprocated fashion along the linear path during the entire winding process. Preferably, the lead screw has a variable pitch to permit different types of fabrics to be rolled to different widths.

Preferably, the web retaining member includes at least one tensioning element which permits a constant force to be applied against the web output during a winding operation, regardless of the amount of knit fabric (e.g., diameter) which has been already wound onto the collecting means from the knitting machine. Preferably, the web retaining member maintains a substantially constant distance relative to the outer diameter of the formed roll, such as through a pivotal connection between the web retaining member and the web winding apparatus.

The assembly further includes at least one cover which prevents dust, lint or other particulates from compromising or damaging the lead screw or other components of the web winding apparatus. Preferably, a pair of flexible bellows are disposed in overlaying relation at opposite ends of the drive axle so as to cover significant axial portions of the lead screw assembly, the bellows, however, being sufficiently flexible to permit the movable portion of the lead screw assembly to engage therewith during travel without interference with the traverse mechanism.

Preferably, the web winding apparatus maintains tension on the web output in spite of the varying diameter of the supported or collected roll of fabric. Preferably, the web-retaining member is pivotally supported to the traverse means to accept an increasing diameter roll.

An advantage of the present invention is that the reciprocated movement of the herein described web winding assembly permits a wider roll of web material to be formed, therefore a greater volume of web material can be wound into a roll format for storage.

Another advantage of the present invention is that the herein described winding assembly while improving the overall throughput, does not significantly impact maintenance or reliability, decreases downtime, and requires less supervision during a winding operation.

These and other objects, features, and advantages will become readily apparent from the following Detailed Description which should be read in conjunction with the accompanying drawings.

DETAILED DESCRIPTION

The following description refers to a single embodiment of a web winding apparatus used in conjunction with a rotating cylinder circular knitting machine. It will be readily apparent, however, that the inventive concepts described herein are not intended to be limited to this particular embodiment and can be used, for example, in conjunction with a cylinder and dial circular knitting machine or any other circular knitting machine which includes a rotating member from which a web output originates.

Figure 1:
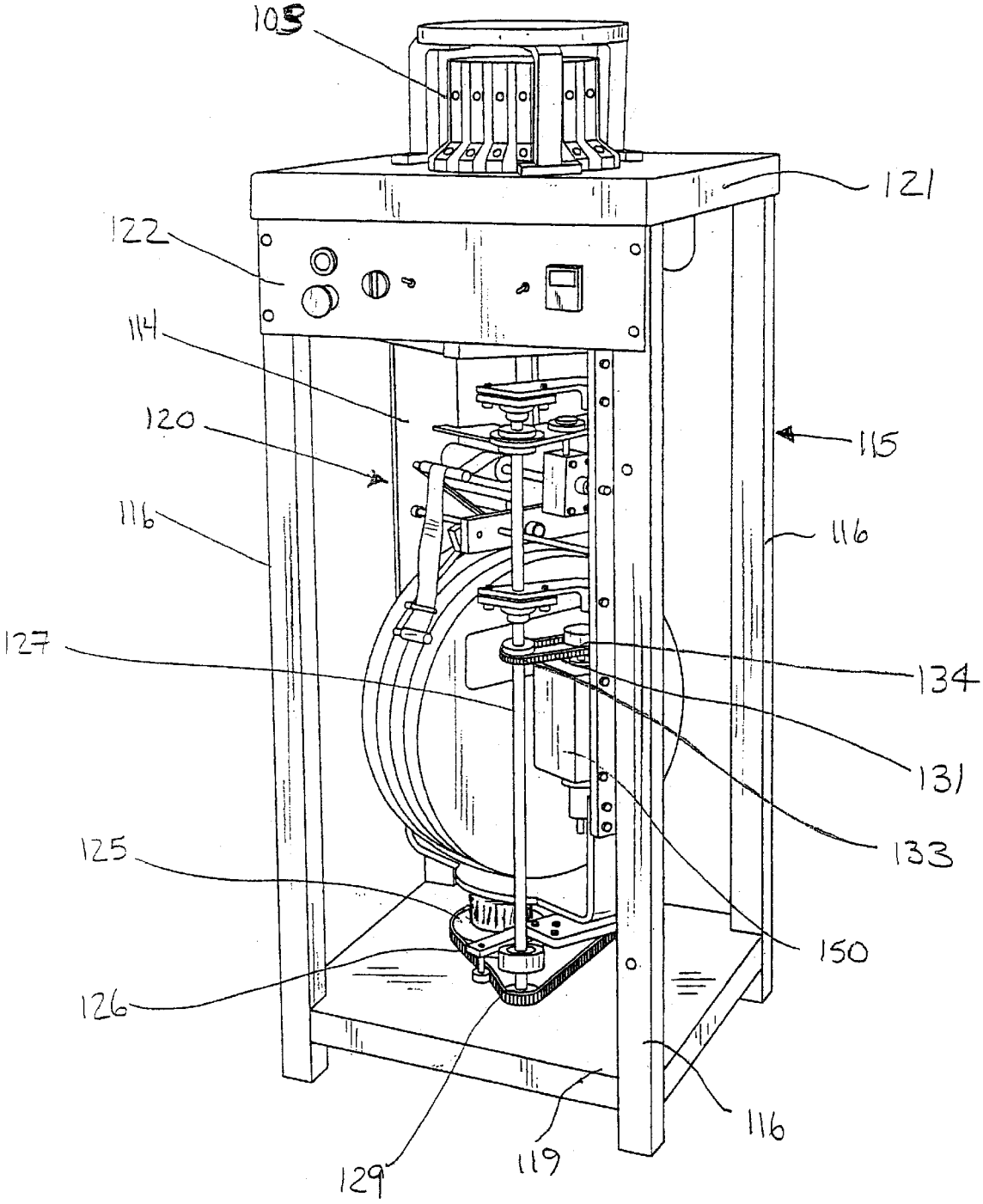
FIG. 1 is a partial front perspective view of a rotating cylinder circular knitting machine including a web winding apparatus made in accordance with a preferred embodiment of the invention.
Figure 2:
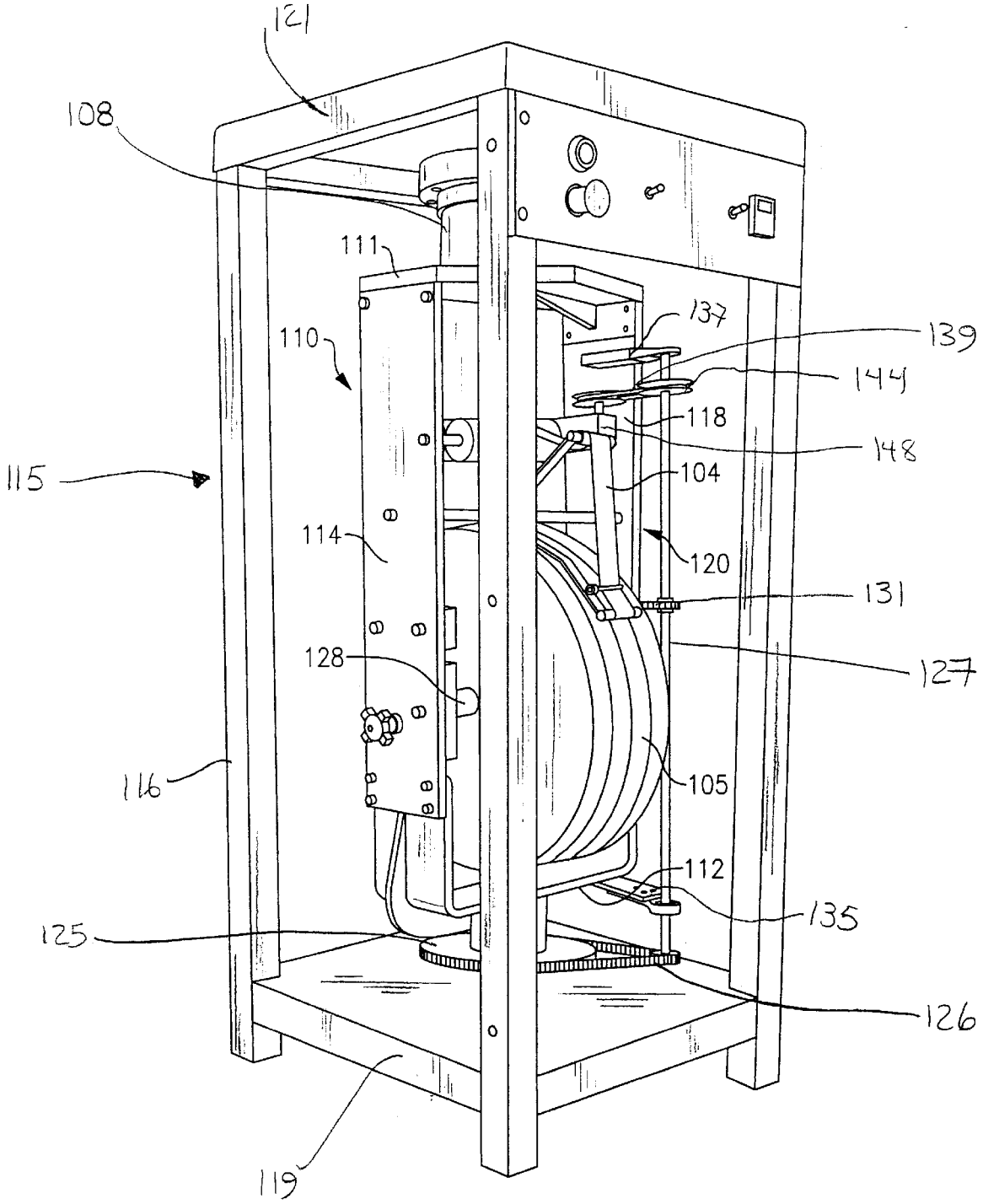
FIG. 2 is a front perspective view of the web winding apparatus of FIG. 1.

Referring to FIGS. 1 and 2, a web of knitting material 104 extends downwardly from a rotating cylinder circular knitting machine 103 (shown only in FIG. 1 and only in part) to a web winding apparatus 120 made in accordance with the present invention. As noted above, the precise type of knitting machine used in conjunction with the web winding apparatus 120 is not critical to the workings of the present invention; that is, other types of circular knitting machines having a rotating member from which created knit web material is outputted can be utilized. Examples of rotating cylinder circular knitting machines which are useful in regard to the present invention are described in U.S. Pat. Nos. 4,765,157, 5,575,162 and 5,881,571, the entire contents of each of which are herein incorporated by reference.

According to this embodiment, the web winding apparatus 120 is positioned directly beneath the rotating cylinder circular knitting machine 103 and more particularly between a pair of vertically positioned end plates 114, 118 of a support frame 110. The support frame 110 is defined by respective top and bottom structures 111 and 112 and a pair of lateral end plates 114, 118. As detailed below, the entirety of the support frame 110 is drivingly coupled to the rotating element(not shown) of the rotating cylinder circular knitting machine 103 disposed above in order to permit rotation of the support frame and the contained web winding apparatus 120 in synch with the rotation of the rotating element of the knitting machine 103. According to the present embodiment, the top structure 111 of the support frame 110 includes a casing 108 which is fixedly linked to the rotating element (not shown) of the knitting machine 103, though other coupling means, including drive belts (not shown) and the like, could be utilized.

The support frame 10 is retained within an open enclosure or cabinet 115 having a plurality of support legs 116 interconnecting a bottom plate 119 and a top plate 121 spaced therebetween. The rotating cylinder of the knitting machine 103 is mounted to the rotating element (not shown) adjacent to the top plate 114. The rotating element includes an opening (not shown) permitting web output to extend therefrom and be directed to the web winding apparatus 120. The bottom structure 112 of the supporting frame 110 is attached to a shaft which is mounted to a bearing block which allows rotation of the bottom structure. The bearing block is mounted to the bottom plate 119. A sprocket 125 is mounted to the bearing block which is fixed so as to permit rotation of the supporting frame 110. A first drive chain 126 is mounted in horizontal relation to the drive sprocket 125 and to a drive sprocket 129 which is disposed at one end of a vertical primary drive shaft 127.

Intermediately disposed along the vertical primary drive shaft 127 is a second drive chain 131 which is also horizontally disposed about a sprocket 133 mounted onto the shaft. The second drive chain 131 extends to a sprocket 134 attached to an upper end of a gearbox 150. The vertical primary drive shaft 127 extends upwardly and is supported for rotation about its main axis, the shaft being coupled by braces 135, 137, FIG. 2, to the support frame 110 and move particularly one of the to end plates 118. The shaft also includes a horizontally disposed drive belts extending into the upper port of the support frame which engages pulleys relative to a gearbox 148 which drives a set of take down rollers 106.

The above description is provided for background and describes in general the coupling of the rotating drive element of the knitting machine 103 to the web winding apparatus 120. As the drive element rotates, its fixed coupling to the casing 108 causes rotation of the support frame 110 about the cylinder axis. The fixed sprocket causes the first drive chain 126 to effect rotation of the vertical primary drive shaft 127 causing the second drive chain 131 to drive the elements of gearbox 150 and the drive belt 139 to drive the gearbox 148 to effect synched rotation of the web winding apparatus 120, as described below, and the take down rollers 106. To this point, the above described portions of a rotating cylinder circular knitting machine apparatus, including the synched coupling to a web winding apparatus is known commercially, such as manufactured by Tompkins Brothers Company of Syracuse, N.Y.

Referring to the herein-described web winding apparatus 120, including the drive mechanism and coupled supporting frame is used in conjunction with a roll supporting or collecting assembly 128 in accordance with the present invention. Briefly, the above described drive mechanism 124, causes rotation of a roller element of the collecting assembly 128 and the take down rollers 106 in order to pull an extending web output from the knitting machine 106 and to cause reciprocated movement of a drive axle 136 of the web winding apparatus 120.

The web winding apparatus 120 further includes a web-retaining or guide member 160 which permits a web output of fabric 104 to be directed from the knitting machine 106 to the roll collecting assembly 128. As noted, the collecting assembly 128 includes a roller element, such as a spool, a core, or other similar member, which is provided adjacent to the gearbox 150 as provided in a lowermost portion of the support frame 110.

An extending end of the web fabric output 104 from the knitting machine 103 is initially secured to the roller element after the web output is first threaded through portions of the take down rollers 106 and the web retaining member 160 along a web transport path, as described in greater detail below. The roller element of the collecting assembly 128 is rotated about a horizontal axis through a connection of an end of the roller element to a drive shaft 152, FIG. 3, of the gearbox 150 to form a roll 105 of knit material, the remaining end of the roller element being attached to an opening 117 in the end plate 114.

Figure 3:
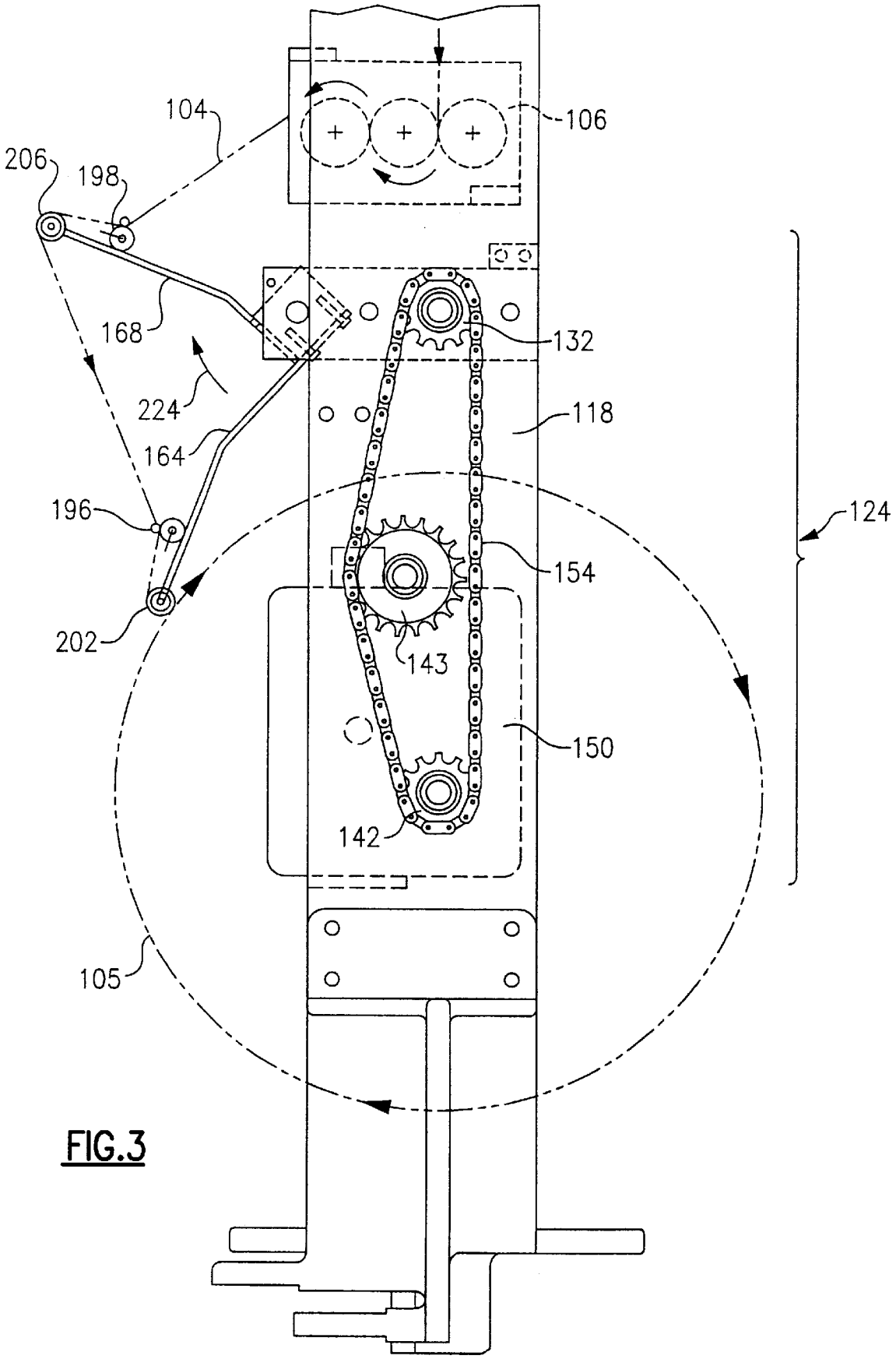
FIG. 3 is a side elevational view of the web winding apparatus depicted in FIGS. 1 and 2.
Figure 4:
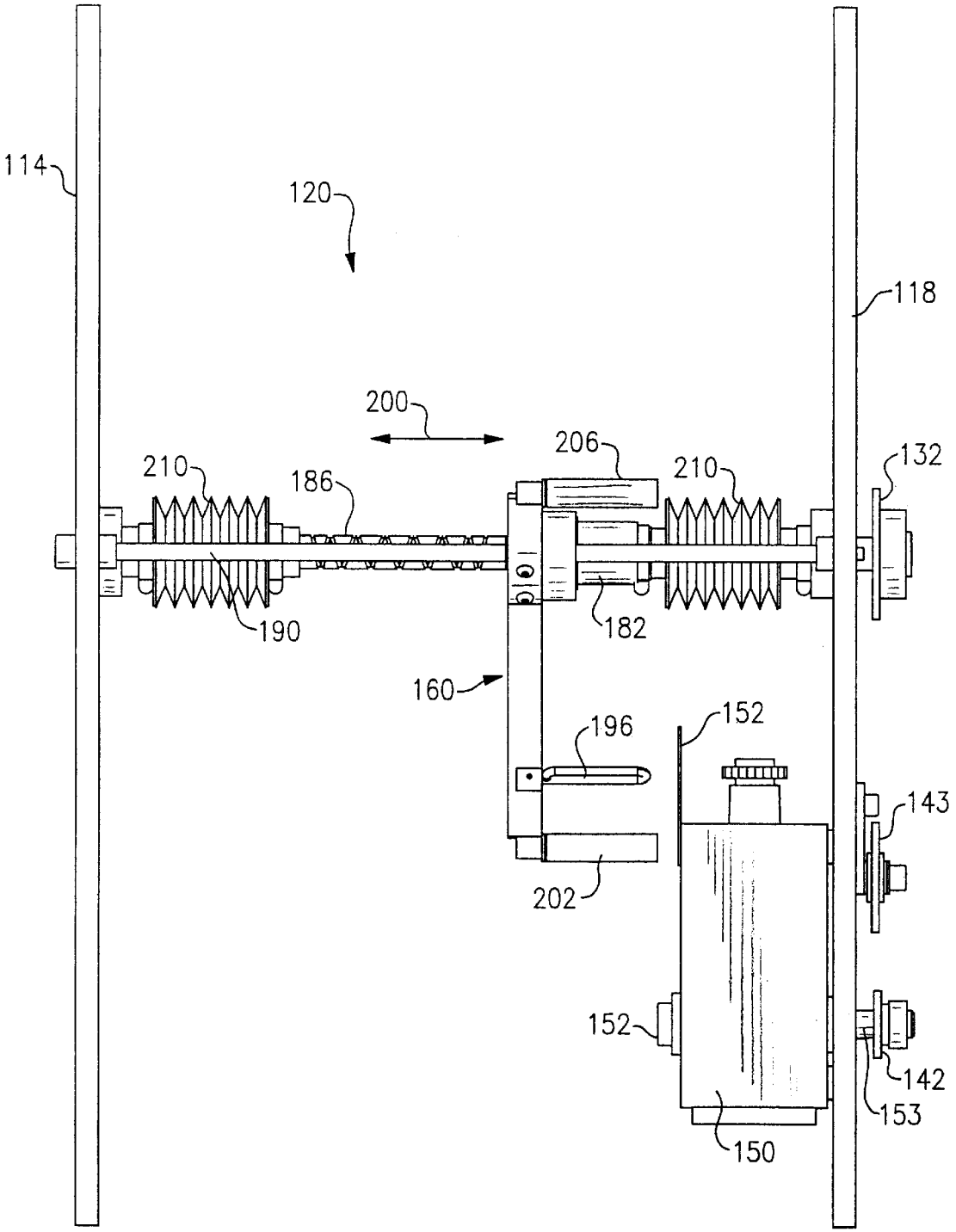
FIG. 4 is a partial front view of the web winding apparatus of FIGS. 2 and 3.
Figure 5:
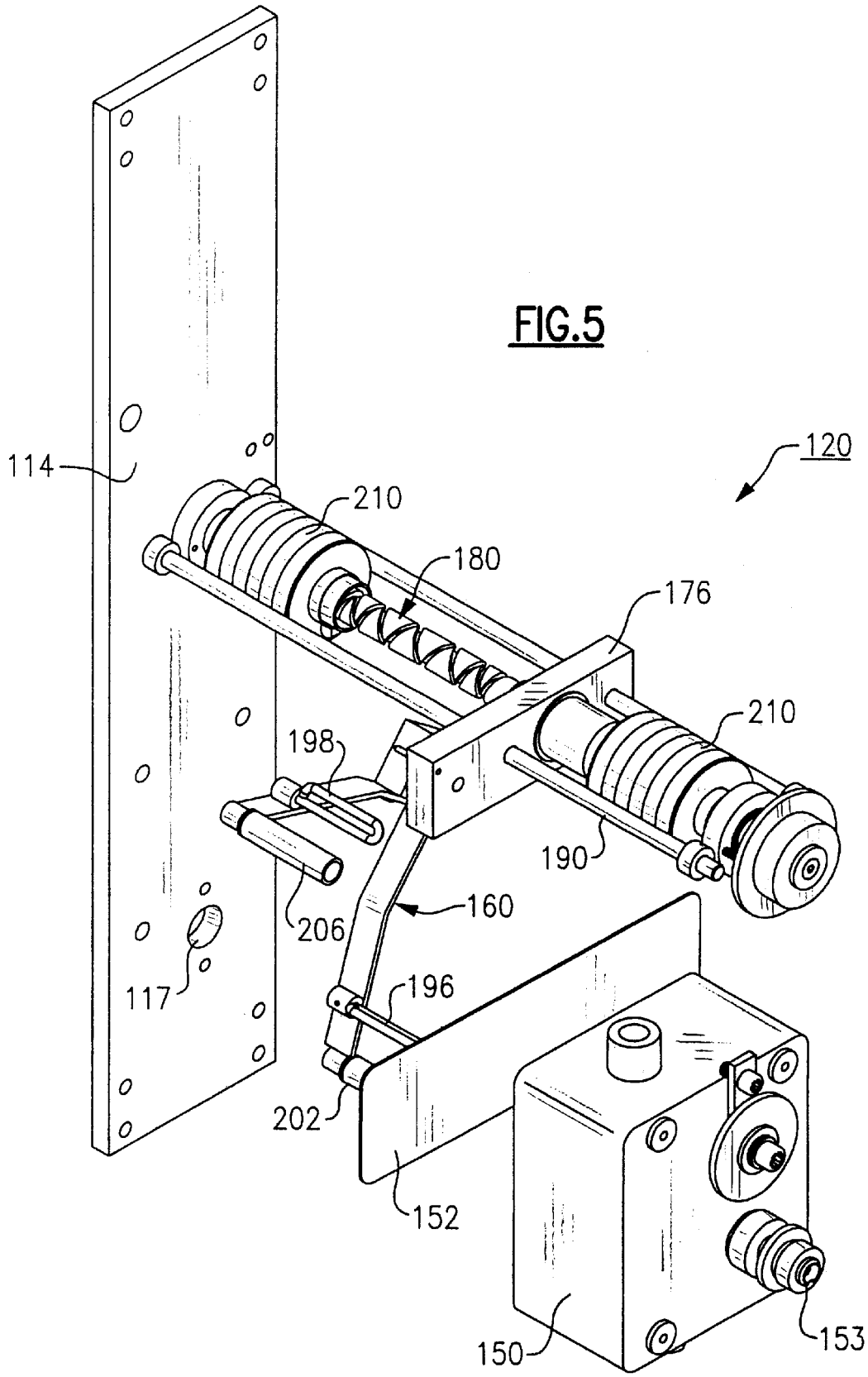
FIG. 5 is a partial front perspective view of the web winding apparatus of FIGS. 1–4.

Referring to FIGS. 2, 3 and 5, the drive mechanism 124 for the herein described apparatus includes a first or idler sprocket 132 which is attached to one end of a horizontally disposed drive axle 136 that is secured at one end to one of the end plates 118, the end plate having an opening sized for receiving same. A second sprocket 142 is also attached to the exterior side of the end plate 118 and is further engaged with the keyed output end of a rotating drive shaft 153 of the gearbox 150 which as noted above is disposed between the end plates 114, 118 of the support frame 110. Also as previously noted, and inboard of the gearbox 150, the roller element is also attached to a drive component 152 of the gearbox and to the end plate 114 via an opening 117, the roller element being supported for rotation and for supporting the web output which is rolled thereupon. In addition, a guard member 154 is also attached by conventional means to an inboard surface of the gearbox 150, as shown in FIG. 4.

A vertically disposed drive chain 154, shown only in FIG. 3, is fitted over each of the sprockets 142, 132 and interconnects the drive axle 136 with the gearbox 150 to provide rotation thereof. The end of the drive axle 136 includes a keyed shaft which engages the sprocket 142, each of the ends of the drive axle including bearings (not shown) to promote rotational support. A third sprocket 143 is provided intermediately between the first and second sprockets 142, 132, as a chain tensioner. The herein drive mechanism 124 causes the roller element of the collecting assembly and the drive axle 136 of the web winding apparatus 120 to rotate synchronously to enable knitted web material 104 to be pulled from the knitting machine 103 disposed above.

Figure 6:
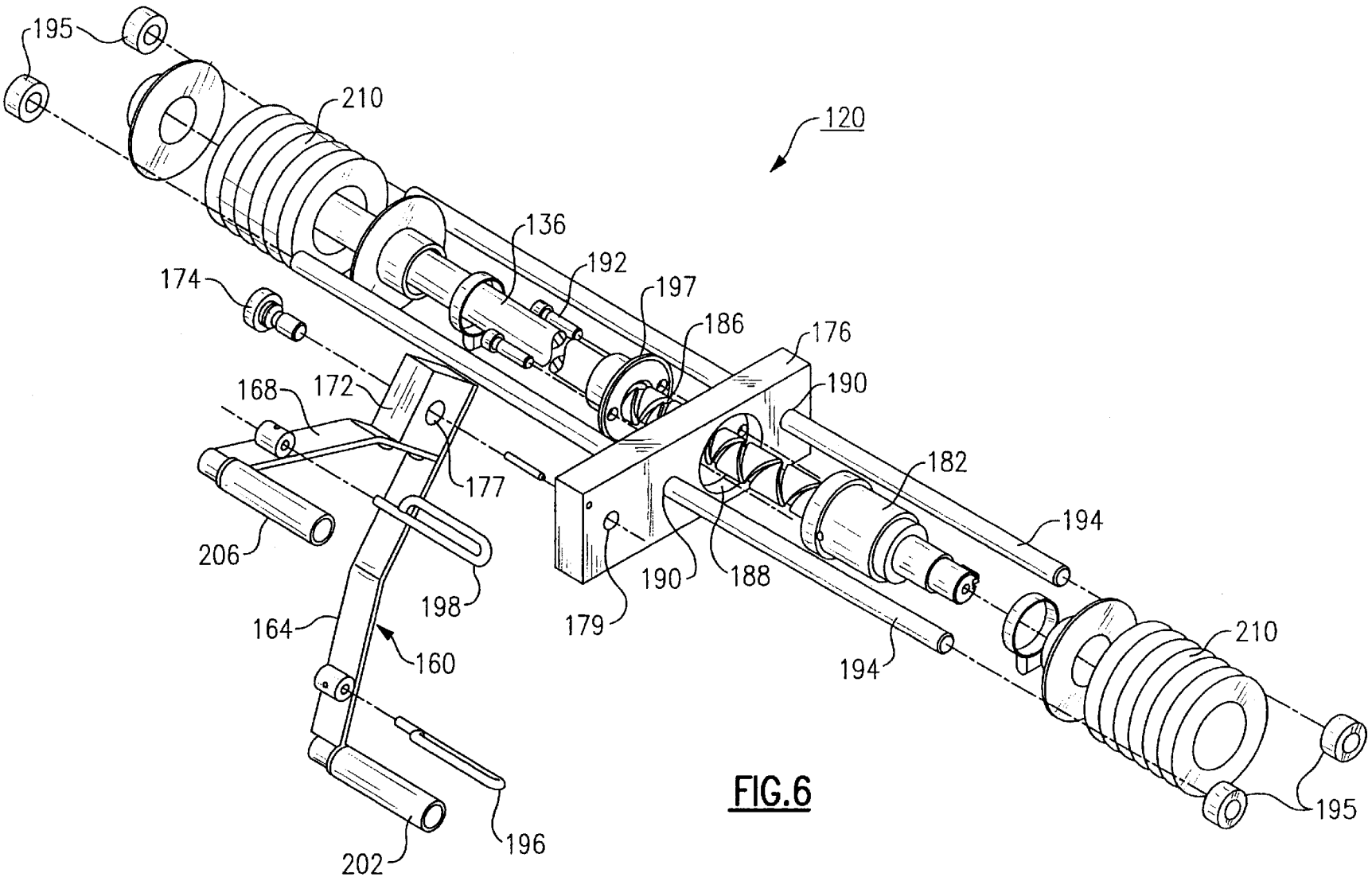
FIG. 6 is a partial exploded front perspective view of the traversable portion of the web winding apparatus of FIGS. 1–5.

Referring to FIGS. 5 and 6, the web winding apparatus 120 further includes a rigid web-retaining member 160 made up of a first guide arm 164 and a second guide arm 168, each of the guide arms extending outwardly from the support frame 110, FIG. 2, and angled relative to one another. The web-retaining member 160 is fixedly secured by means of a weldment 172 disposed between the first and second guide arms 164, 168 to a support block 176 using conventional means. According to this embodiment, a fastener 174 such as a shoulder screw, extends through respective openings 177, 179 provided in the weldment 172 and the support block 176.

Figure 7:
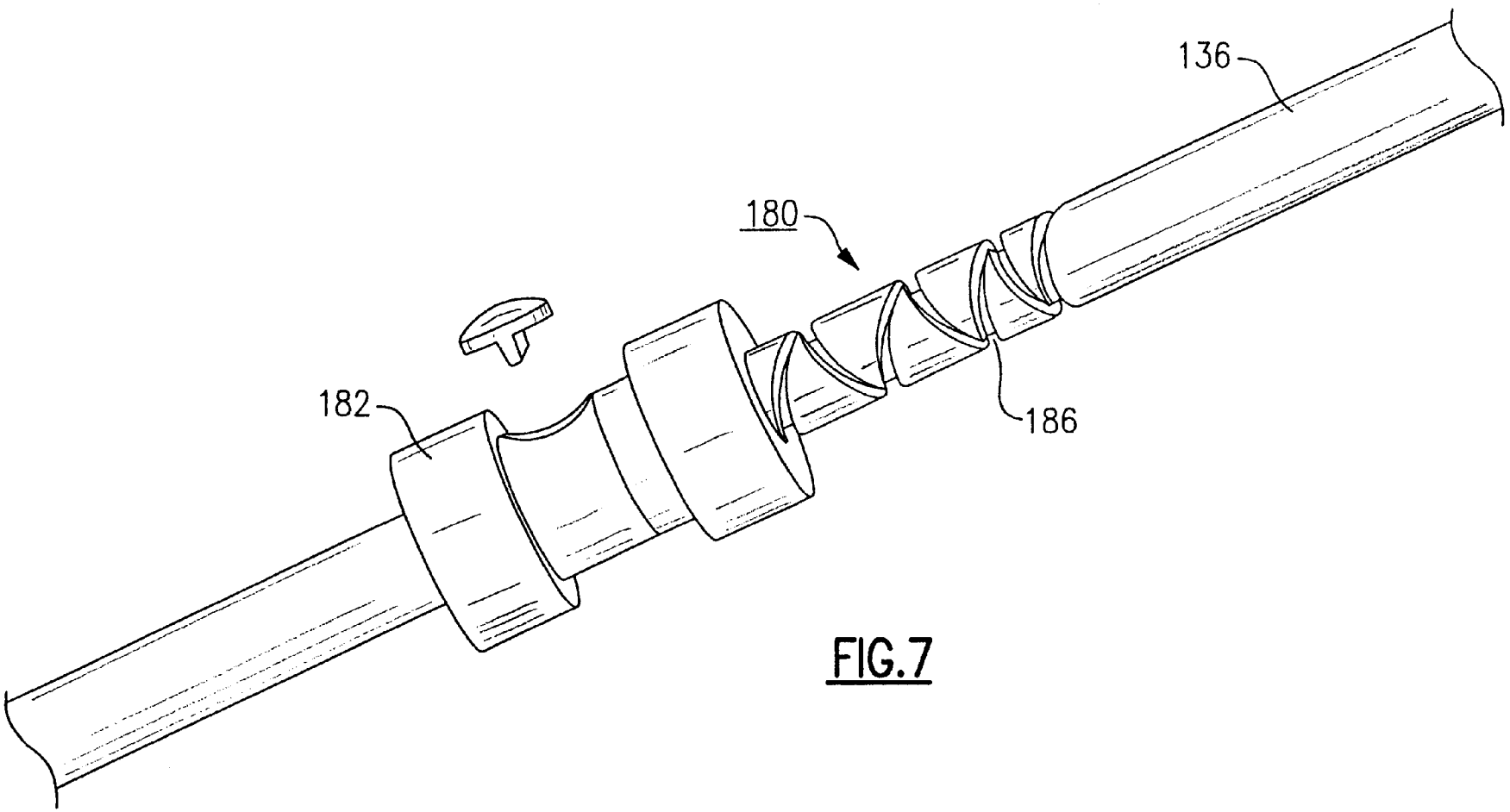
FIG. 7 is a partial perspective view of the lead screw assembly of the web winding apparatus of FIGS. 1–6.

The support block 176 is fixedly attached to a movable component 182 of a mechanical lead screw assembly 180 which comprises substantially the center of the axial span of the drive axle 136. As shown in FIGS. 5–7, the lead screw assembly 180 includes a movable lead screw component 182 overlaying a helically disposed track 186. The movable component 182 is fixedly retained to the support block 176 using a cap 197 secured to the movable component 182 through use of a pair of fasteners 192 which are attached through openings 188 provided on a mounting surface of the support block 176, the block further including a pair of adjacent openings 190 which permit traversal of the movable component 182 and the support block 176 along a pair of parallel horizontal guide rods 194 which are radially spaced apart from the drive axle 136. The ends of the guide rods 190 are fixedly attached to each of the vertically disposed supporting plates 114, 118 of the support frame 110, respectively, such as through collars 195 according to this embodiment.

A key aspect of the present invention is that the web-retaining member 160, being fixedly attached to the support block 176, is axially and reciprocally movable based on the movement of the movable component 182 of the lead screw assembly 180. This axial movement permits a wider roll of fabric to be wound onto the collecting assembly 128.

Referring to FIGS. 5 and 6, a pair of bellows 210 cover the ends of the drive axle 136, including axial portions of the exterior helically disposed track 186 of the lead screw assembly 180, and act as covers to prevent dust, lint and other particulates from entering and clogging the lead screw assembly 180. In addition each of the bellows 210 are flexible, thereby permitting the movable component 182 to complete its range of travel in both directions, shown by arrow 200, while still permitting the drive axle 136 to be effectively covered and protected during the winding operation.

Figure 8:
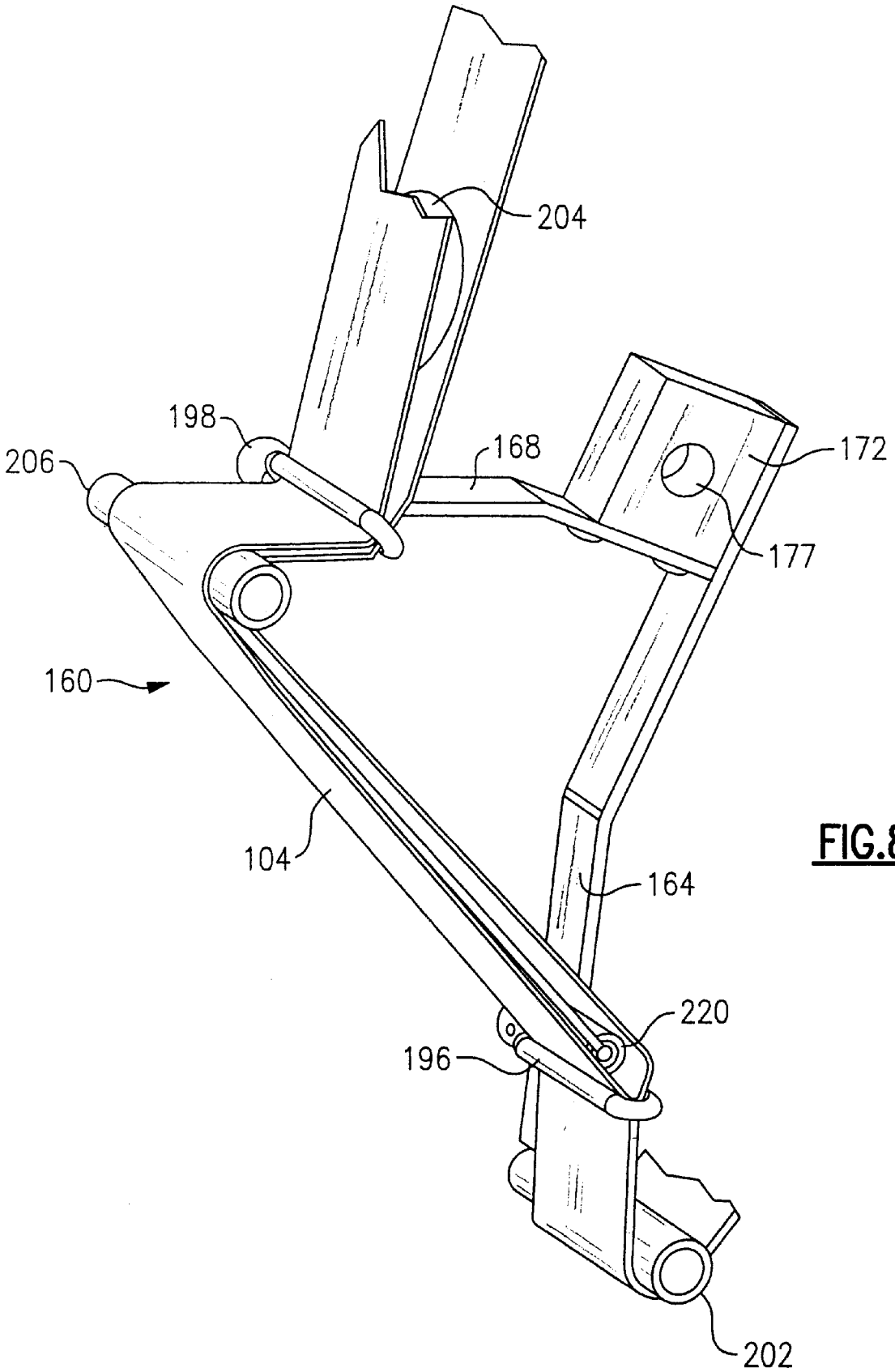
FIG. 8 is a side perspective view of a portion of the web winding apparatus of FIGS. 1–7.

Referring to FIG. 8, each of the first and second guide arms 164, 168 of the web-retaining member 160 include a slotted fabric guide 196, 198 which is attached to a bracket provided thereupon in spaced relation to an end roller 202, 206.

In operation, an extending portion of knitted web output 104 is initially pulled from the knitting machine 106 and is threaded through the web-retaining member 160. More particularly, the web output is in a cylindrical form as it leaves the rotating cylinder and enters the web winding assembly. The web output 104 is passed between the series of take down rollers 106 disposed in the upper part of the support frame 110 and is pulled therefrom in adjacent sections 104A and 104B which are spread initially about a spacer disc 204 disposed in relation to the web-retaining member 160 during the initial threading thereof. The web output and more particularly, the web sections 104A and 104B are fed along a defined web transport path through the slotted portion of the fabric guide 198 of the second guide arm 168 over the end roller 208, through the slotted portion of the fabric guide 196 of the first guide arm 164 and then over the roller 206. A spreader arm 220 is placed between the adjacent web sections 104A, 104B, the arm extending between the fabric guide 196 of the first guide arm 164 and the end roller 206 of the second guide arm 168, the arm providing tension thereupon. The web output 104A and 104B is then threaded over the end roller 202 of the first guide arm and onto the roller element of the collecting assembly 128.

As the web sections 104A and 104B are taken up by the roller element of the collecting assembly, the movable component 182 of the drive axle assembly 180 is caused to traverse along the helically disposed track 186 through rotation of the drive axle 136 through the interconnection of same to the drive mechanism 124. The fixed attachment of the support block 176 to the movable component 182 of the lead screw assembly 180 causes horizontal movement of the web-retaining member 160 based on its attachment to the support block 176. This horizontal movement permits a wider roll 105 of web material to be collected onto the roller element, the additional width of the web material being dictated by the extent of axial movement of the web-retaining member 160.

Moreover and according to this particular embodiment, the web retaining member 160 is permitted to move along an angular path, depicted by arrow 224 in FIG. 3, based on the pivotal connection thereof to the support block 176. The nature of this pivotal connection permits a larger diameter roll 105 of web to be formed, see FIG. 3, without otherwise influencing the tension on the web 104 as it is pulled from the knitting machine 106, due to the spreader arm 220 and maintains the overall distance between the outer diameter of the roll and the web retaining member 160.

PARTS LIST FOR FIGS. 1–8

103 knitting machine
104 web output
104A web section
104B web section
105 formed roll of web material
106 take down rollers

108 casing
110 supporting frame
111 top structure
112 bottom structure
114 end plate
115 open enclosure
116 support legs
117 opening
118 end plate
119 bottom plate
120 web winding assembly
121 top plate
122 control panel
124 drive mechanism
125 fixed sprocket
126 first drive chain
127 vertical drive shaft
128 roll supporting assembly
129 sprocket
131 second drive chain
132 sprocket
133 sprocket
134 sprocket
135 brace
136 drive axle
137 brace
138 gear box
139 third drive belt
142 sprocket
143 sprocket
144 pulleys
146 rotating shaft
148 gearbox
150 gearbox
151 cover plate or guard
152 drive shaft
153 drive shaft
154 drive chain
160 web retaining member
164 first guide arm
168 second guide arm
172 weldment
174 fastener
176 support block
177 opening
179 opening
180 lead screw assembly
182 movable component
186 track
188 opening
190 opening
192 fasteners
194 guide rods
195 collars
196 fabric guide
197 cap
198 fabric guide
200 arrow
202 roller
204 spacer disc
206 roller
210 bellows
220 spreader arm
224 direction While the present invention has been particularly shown and described with reference to the preferred mode as illustrated in the drawing, it will be understood by one skilled in the art that various changes in detail may be effected therein without departing from the spirit and scope of the invention as defined by the claims.

What is claimed is:

1. A winding apparatus for receiving the web output of knitted material from a rotating knitting machine, said web-retaining apparatus including a movable assembly being supported along a first axis which is perpendicular to a web transport path;

collecting means for collecting said web output in a rolled form;

cover means for preventing particulates from clogging the movable assembly;

drive means for rotating said collecting means;

traverse means for permitting said movable assembly to move in a reciprocating fashion along a linear path extending along said first axis to permit additional width of web output to be wound onto said collecting means; and a web retaining member having guide means for guiding web output from a knitting machine to said collecting means, said web-retaining member being fixedly attached to a movable component of said movable assembly.

2. Apparatus as recited in claim 1, wherein said cover means includes a pair of bellows, each of said bellows being mounted in overlaying fashion relative to a portion of said movable assembly.

3. Apparatus as recited in claim 2, wherein said bellows are flexible and permit movement thereof when engaged by said movable assembly.

4. Apparatus as recited in claim 1, wherein said collecting means includes a roller element onto which web output is collected.

5. Apparatus as recited in claim 1, wherein said movable assembly includes a lead screw assembly having said movable component which traverses a portion of a drive axle.

6. Apparatus as recited in claim 5, wherein said drive axle is connected to said drive means to cause rotation thereof.

7. Apparatus as recited in claim 1, wherein said web-retaining member includes means for providing tension on the web output being fed to the collecting means.

8. Apparatus as recited in claim 6, wherein said web-retaining member is pivotally connected to said movable component of said lead screw to permit said tension providing means to provide substantially constant tension in spite of variations in the diameter of a collected roll.

9. Apparatus as recited in claim 5, wherein said movable component of said lead screw is fixedly attached to a support block, said support block being attached to said web-retaining member.

10. Apparatus as recited in claim 1, wherein said guide means includes at least one slotted fabric guide disposed in relation to an end roller through which said web output is threaded.

11. Apparatus as recited in claim 10, wherein said web-retaining member includes a pair of angled guide arms, each of said guide arms including at least one said fabric guide and said roller.

* * * * *